US007056421B1

(12) United States Patent
Ferguson, III et al.

(10) Patent No.: US 7,056,421 B1
(45) Date of Patent: Jun. 6, 2006

(54) UNDERFLOW WATERBOX

(75) Inventors: James L. Ferguson, III, North Augusta, SC (US); James L. Allen, Jr., Hephzibah, GA (US)

(73) Assignee: International Paper Company, Stamford, CT (US)

( * ) Notice: Subject to any disclaimer, the term of this patent is extended or adjusted under 35 U.S.C. 154(b) by 200 days.

(21) Appl. No.: 10/192,179

(22) Filed: Jul. 10, 2002

Related U.S. Application Data

(60) Provisional application No. 60/304,357, filed on Jul. 10, 2001.

(51) Int. Cl.
*D21H 11/00* (2006.01)

(52) U.S. Cl. ..... 162/361; 162/206; 162/265; 162/280; 162/282; 118/410; 118/419; 427/364; 427/356

(58) Field of Classification Search ..... 162/361, 162/206, 265, 280, 282; 118/410, 419; 427/364, 427/356

See application file for complete search history.

(56) References Cited

U.S. PATENT DOCUMENTS

| | | | | |
|---|---|---|---|---|
| 388,921 | A | | 9/1888 | Shartle |
| 638,757 | A | | 12/1899 | Pratt |
| 1,857,497 | A | | 5/1932 | Clapp |
| 1,864,852 | A | | 6/1932 | Oblinger |
| 2,130,530 | A | | 9/1938 | Fletcher |
| 2,329,277 | A | | 9/1943 | Lodding |
| 2,920,558 | A | | 1/1960 | Hewlett |
| 3,024,129 | A | * | 3/1962 | Brundige ..... 427/364 |
| 3,139,374 | A | | 6/1964 | Goyette |
| 3,220,339 | A | | 11/1965 | Keyworth et al. |
| 5,522,312 | A | | 6/1996 | Johnson |
| 6,113,743 | A | * | 9/2000 | Vice et al. ..... 162/361 |

* cited by examiner

*Primary Examiner*—Mark Halpern
(74) *Attorney, Agent, or Firm*—Matthew M. Eslami

(57) ABSTRACT

The specification discloses a waterbox for applying an aqueous mixture, such as a starch mixture, to a web in a calender stack. The waterbox includes a spillway disposed adjacent a calender stack having a bottom plate, substantially parallel front and rear walls, and substantially parallel first and second end walls. The waterbox also includes an elongate lip for which extends from adjacent the front wall of the reservoir to a position adjacent a roll of the calender stack to form a pond area. A weir is provided for controlling the amount of mixture in the pond. Additionally the waterbox includes an inlet or a plurality of inlets for introduction of mixture into the pond area located below the pond level.

20 Claims, 4 Drawing Sheets

--PRIOR ART--

UNDERFLOW WATERBOX

This application claims benefit of application 60/304,357 filed 10 Jul. 2001.

FIELD OF THE INVENTION

The invention relates to a papermaking apparatus and, in particular, to an improved design for a waterbox for use with a papermaking calender stack.

BACKGROUND OF THE INVENTION

Paperwebs are generally processed in a calender stack to establish the final caliper of the web and to improve the smoothness and uniformity of the web as well as other properties. In many instances, the calender stack also includes a waterbox. As the paper web is pressed through the calender stack, the waterbox is used to apply a controlled amount of water to the web, often together with certain additives such as starch.

The waterbox is a long, somewhat elongate trough-like structure with a lip extending from and along one side adjacent a roll on the calender stack which is used to supply the water-starch or other solution or mixture to the web as it passes through the adjacent calender nip. The waterbox is typically opened from overhead and liquid solution is conventionally supplied to the waterbox via a plurality of overhead nozzles spaced-apart along the length of the box. The nozzles are arranged so their openings cause a starch mixture to be delivered into the open top of the waterbox at spaced-apart locations from above the mixture level.

One problem with this overhead nozzle design is that the nozzles tend to become encrusted with dried starch residue because of splashing, which is inherent in the operation of the waterbox and calender. Due to the elevated temperatures of the calender stack, the water quickly evaporates from the splashings, causing a rapid build up of starch on the nozzles and other structure in and around the waterbox. Eventually, pieces of this dried starch break loose and enter the calender nip creating defects in the paper. Such paper defects are sometimes referred to as paper "scabs".

In order to limit this starch buildup from fouling the calender stack and causing paper scabbing, it has been necessary to make frequent stoppages of the calender and remove the starch buildup using high pressure and/or high temperature cleaning sprayers. Because of the high pressures and temperatures, such cleanup procedures pose a significant threat of heat stress or other injury to workers. Moreover, valuable production time is lost with each stoppage of the papermaking line.

In addition to scabbing problems, conventional waterboxes also tend to develop non-uniformities in the concentration of aqueous mixture components such as starch, resulting in more highly concentrated zones of starch within the waterbox which often appear between overhead nozzles. These zones are sometimes called "hot spots". The formation of hot spots can lead to wrinkling and/or corrugating of the paperweb, due to sharp or abrupt concentration differentials in the starch applied to the web.

Accordingly, it is an object of the invention to provide a novel waterbox design which improves upon conventional designs in regard to scabbing, hot spots, and other problems.

SUMMARY OF THE INVENTION

With regard to the foregoing, the present invention provides a waterbox for applying an aqueous mixture to a web in a calender stack. The waterbox includes an open-top elongate spillway disposed adjacent a calender stack having a bottom plate, substantially parallel front and rear walls, and substantially parallel first and second end walls. The waterbox also includes an elongate lip area which extends from adjacent the front wall of the spillway to a position operably adjacent a roll of the calender stack on which the web is disposed in order to provide a pond of the mixture which may flow from the lip onto the web. A weir is provided for controlling the level of mixture in the pond such that the flow of the mixture from the pond onto the web is maintained and disposed intermediate said lip and said rear wall and having a height selected to provide a basin within which the mixture may collect. Additionally, the waterbox includes an inlet for introduction of liquid solution into the lip area which is located below the lip liquid level.

In another embodiment, the waterbox may include a spillway disposed adjacent a roll of a calender stack having a bottom plate, substantially parallel front and rear walls, and substantially parallel first and second end walls. An elongate pond area is provided for supplying the mixture to the calender stack which extends from adjacent the front wall of the spillway to a position adjacent a roll of the calender stack. The waterbox also includes a weir for controlling the amount of mixture in the pond area and establishing a pond mixture level and an inlet for introduction of mixture into the pond area which is located below the pond mixture.

More preferably the water box includes a plurality of inlets for introduction of mixture into the lip or pond area which are located below the pond level. In one preferred embodiment, the plurality of inlets are located in the lip.

It is also preferred that the elongate lip include a rubber edge which contacts the calender stack roll.

While it is envisioned that the waterbox of the invention may be used to apply a variety of liquids to a web at the calender stack, it is preferred that the mixture comprises an aqueous starch mixture.

In still another preferred embodiment of the invention, the waterbox weir may be adjusted to vary the lip liquid level. Preferably, the top of the weir is substantially flat and smooth. It is also preferred that the waterbox include at least one liquid mixture outlet located in the bottom plate for removing excess mixture from the waterbox.

In another embodiment, the waterbox includes at least one header and a plurality of inlet supply pipes or conduits for supplying the mixture to the plurality of inlets, wherein the header and the inlet supply pipes are all located outside of and adjacent to the waterbox. It is also preferred that each inlet supply pipe include at least one valve for regulating flow of mixture and each valve be located outside of and adjacent to the waterbox. More preferably, the interior of the waterbox does not include any piping or valve fixtures.

In still another embodiment, the invention provides a waterbox for applying an aqueous mixture containing starch to a substantially continuous, relatively wide paper web carried on a roll of a calender stack associated with a papermaking machine. The waterbox includes an elongate trough supported adjacent the roll of the calender stack, the trough having an elongate pond portion closely adjacent the roll and an elongate spillway portion separated therefrom by an elongate weir so that mixture collecting in the pond portion in excess of the capacity thereof flows over the weir into the spillway portion. The waterbox also comprises a flexible elongate lip supported on the trough along a front edge thereof adjacent the pond portion and disposed, at least in part, between the front edge and the roll so that mixture collected in the pond portion will flow from the pond along the lip and onto the web carried on the roll. A plurality of spaced-apart inlet conduits are connected in flow communication with the pond portion of the trough for delivering the mixture into the pond portion at a plurality of spaced-apart inlet openings along the pond portion and below the level of the mixture collecting therein so that substantially the entire supply of mixture to the trough enters via the pond portion as underflow therein through the inlet openings. Additionally, the system includes a tank containing a supply of the mixture connected via a supply header in flow communication with the inlet conduits and via a recirculating conduit to an outlet opening in the spillway portion and means for causing the mixture to flow from the supply tank to the water waterbox via the header and inlet conduits.

In another aspect, the invention relates to a method for applying an aqueous mixture to a web in a calender stack. The method includes providing a waterbox adjacent a roll of a calender stack, the waterbox including a spillway having a bottom plate, substantially parallel front and rear walls, and substantially parallel first and second end walls; an elongate pond area for supplying the solution to the calender stack which extends from adjacent the front wall of the spillway to a position adjacent a roll of the calender stack; a weir for controlling the amount of mixture in the pond area and establishing a pond mixture level; and an inlet for introduction of mixture solution into the pond area which is located below the pond mixture. An aqueous mixture is supplied to the pond area from the inlet below the pond level. The method also includes directing a moving web through the calender stack so that the web directly contacts the mixture in the pond area and a coating of the mixture is thereby applied to the moving web.

The invention also provides a method for applying an aqueous mixture containing starch to a substantially continuous, relatively wide paper web carried on a roll of a calender stack associated with a papermaking machine. The method includes providing an elongate trough supported adjacent the roll of the calender stack, the trough having an elongate pond portion closely adjacent the roll and an elongate spillway portion separated therefrom by an elongate weir so that mixture collecting in the pond portion in excess of the capacity thereof flows over the weir into the spillway portion. The method also includes supporting a flexible elongate lip on the trough along a front edge thereof adjacent the pond portion and disposed, at least in part, between the front edge and the roll so that mixture collected in the pond portion will flow from the pond along the lip and onto the web carried on the roll. The aqueous mixture is flowed a plurality of spaced-apart inlet conduits in flow communication with the pond portion of the trough to deliver the mixture into the pond portion at a plurality of spaced-apart inlet openings along the pond portion and below the level of the mixture collecting therein so that substantially the entire supply of mixture to the trough enters via the pond portion as underflow therein through the inlet openings. The excess mixture is then collected via an outlet opening in the spillway portion and recirculated.

Advantageously, according to the present invention, overhead starch buildup is reduced as well as the tendency of the starch to break off and foul the calender because the inlet pipes are now beneath the waterbox liquid level and there are no overhead pipes or nozzles. Thus, product defects due to starch fragments entering the calender are reduced. Moreover, maintenance and cleanup of the waterbox is simplified since there are no overhead pipes and nozzles to remove starch buildup from.

BRIEF DESCRIPTION OF THE DRAWINGS

The above and other aspects and advantages of the invention will now be further described in conjunction with the accompanying drawings in which.

DETAILED DESCRIPTION OF THE INVENTION

Figure 1:
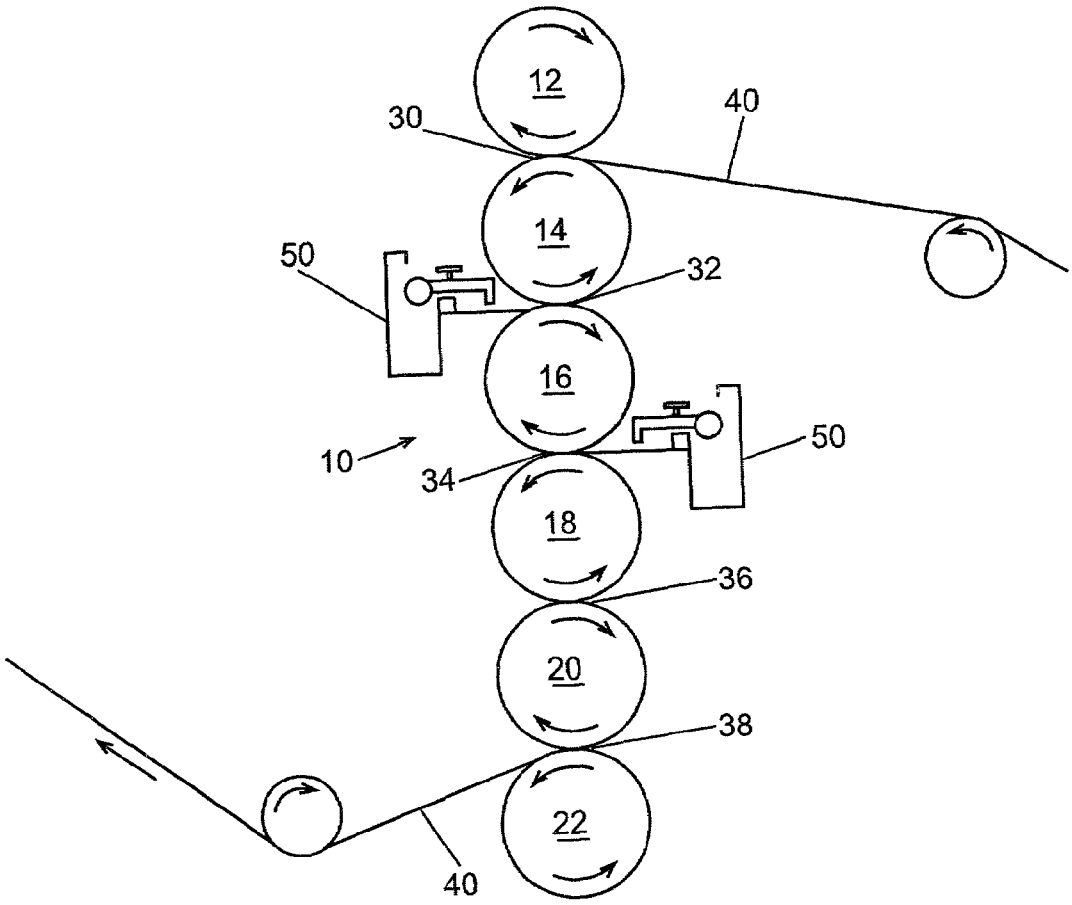
FIG. 1 is an elevational view of a papermaking calender stack having a plurality of prior art waterboxes.

The invention provides an improved waterbox and associated method for applying an aqueous starch mixture to a continuous paper web on a calendar stack. Referring now to the drawings, various aspects of one embodiment of a waterbox according to the invention will now be described with reference to FIG. 1 wherein there is depicted a typical calender stack 10 for calendering a paper web in connection with a process for making paper. The calender stack 10 is one of the final processes employed in the papermaking process and is used for, among other things, setting the final caliper of the paper as well as to improve smoothness and to apply desired surface treatments and coatings to the paper. The stack is made up of a series of individual calendar rolls 12–22, typically made of steel, which are usually set one upon the other in a substantially vertical configuration within a frame. The close proximity of the calender rolls forms a series of nips 30–38 through which a web 40 is conducted for the calendaring effect. As illustrated in FIG. 1, the web 40 will conventionally enter the first nip 30 formed by the two uppermost rolls 12, 14 and then wind through the successive nips in serpentine fashion before emerging from the bottom of the stack 10. Or, the web 40 may begin its travel at the bottom of a stack and work its way up.

It is also conventional to apply various liquid or aqueous additives and mixture to the web as it passes through the calender stack. In particular, starch in an aqueous mixture is typically added to the web 40 by contacting the web 40 with starch mixture in one or more waterboxes 50 which are attached to the calender stack 10, the individual rolls of which may be heated to evaporate water added to the web. Other additives may also be applied to the paper web at the waterbox 50 along with the starch. The present invention may be employed with any type of conventional starch including both cationic and anionic starch. Other additives known to those of skill in the papermaking art may also be added to the starch mixture according to the invention.

Figure 2:
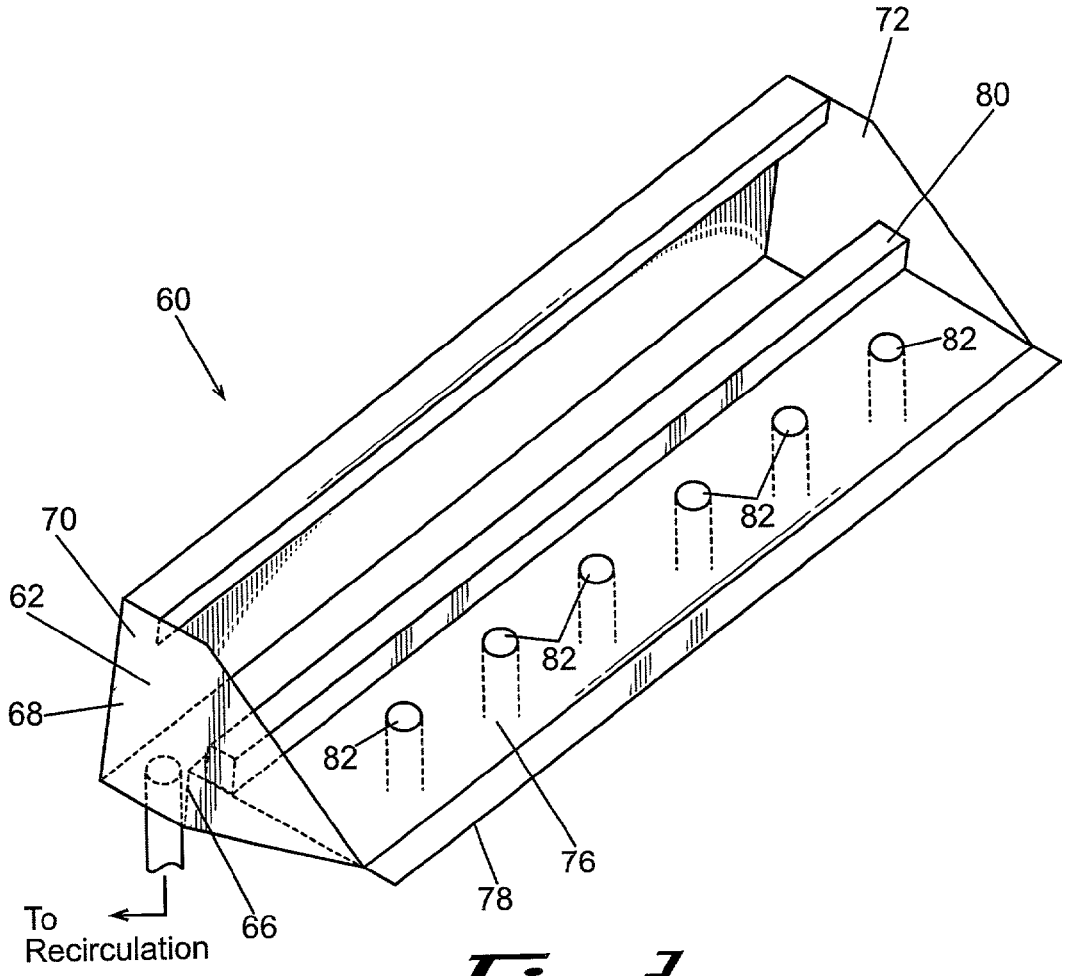
FIG. 2 is a perspective view of a waterbox according to one embodiment of the present invention.
Figure 3:
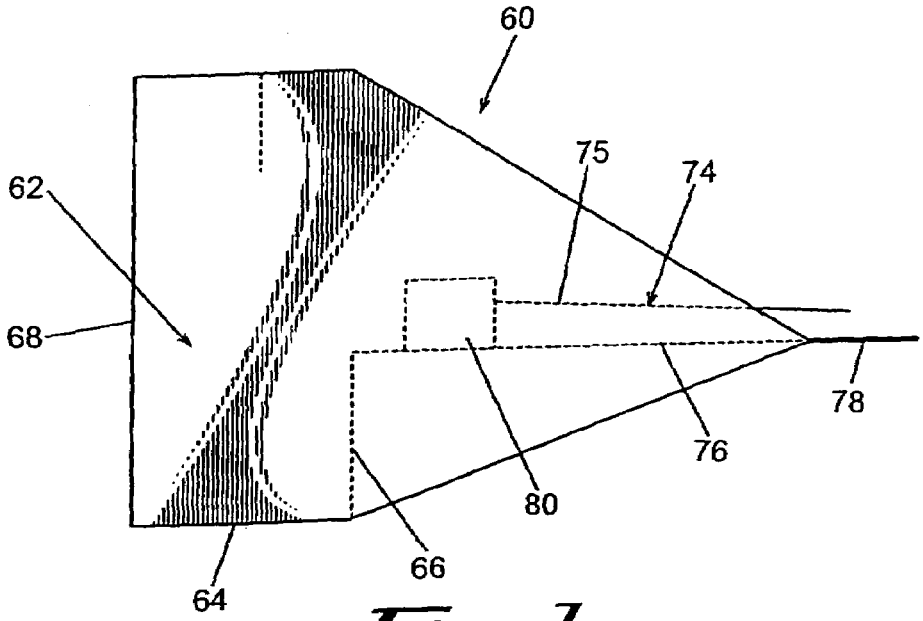
FIG. 3 is an elevational view of a waterbox according to one embodiment of the present invention.

The present invention provides a new waterbox configuration and associated method for use in applying an aqueous starch mixture to a continuous paper web conducted through the calender stack. As seen in FIG. 2 and FIG. 3, the inventive waterbox 60 is an elongate, trough-like structure. The waterbox 60 is formed from a suitable material which is strong, durable, and resistant to high temperatures and to corrosion such as steel, preferably stainless steel.

The waterbox 60 in a preferred embodiment includes a bottom plate 64, a pair of substantially parallel front and rear walls 66, 68, and substantially parallel first and second end walls 70,72 to provide an elongate boxlike enclosure. The waterbox 60 is preferably at least partially open at the top to provide easy assess for cleaning and maintenance and to allow observation of the process by operators. The waterbox 60 may also be attached to the calender stack by means of pivotal and/or slidable mountings so that the waterbox 60 may be moved away from the calender rolls for maintenance purposes.

The waterbox 60 includes a pond portion area 74 wherein the mixture is held as a pond or pool 75 for contacting with the paperweb. This pond area 74 is preferably defined by an elongate plate 76 which projects outward from front wall 66 towards the calender stack 10. An elongate, flexible, liquid sealing lip 78 formed of a material such as neoprene rubber extends along the edge of plate 76 to a position closely adjacent the calender roll and the paperweb. More preferably, the entire lip plate 76 is overlaid with a rubber seal which extends from closely adjacent the calender roll all the way to the back edge thereof and is held down by suitable means. The accumulated mixture in pond 75 flows onto the web carried on a calendar roll along or over the lip 78, which acts in a manner similar to a doctor blade.

At the rear of the pond 75, located approximately over the front wall, is a weir 80 which acts as a dam to regulate the amount and level of starch mixture in the pond 75 for contacting with the paperweb. Like the other components of the waterbox 60, the weir 80 is preferably formed from a strong, durable, and corrosion resistant metal such as steel. It is preferred that the height of weir 80 be adjustable so that the level or depth of the mixture in the pond 75 may also be adjusted. When the level of the mixture exceeds the weir height, the excess mixture spills over the weir 80, is collected in a spillway area 62, and removed therefrom via one or more drain outlets located in reservoir bottom plate 64. This excess may be collected in a storage tank and recirculated to the waterbox pond by a suitable recirculating means such as one or more centrifugal pumps, positive displacement pumps, or by gravity feed. Preferably, the mixture is also filtered prior to being recirculated to remove any accumulated contaminants.

If desired, weir 80 may be permanently affixed to the plate 76 such as by welding. However, it is preferred that the weir 80 be removably fastened to the plate such as by pins, screws, and the like. It is particularly preferred that the fasteners be substantially flush with the upper surface of the weir 80. Fasteners and other structure protruding above the level of the solution in pond 75 have been observed to provide exposed surfaces for dried starch crust formation. Hence, it has been found that elimination of such protruding structures results in a significant reduction in starch crust formation in and around pond 75.

It is a feature of the invention that the starch mixture is delivered to the pond by means of a plurality of inlet openings 82, located below the pond liquid level which has been established by the weir 80 and spaced-apart across the width of the water box (preferably equally spaced). The preferred location for these multiple inlets is in the plate 76 itself. A corresponding opening is also formed in any overlying portion of the rubber seal and the edges of this opening are then preferably sealed to the plate 76. The fresh mixture therefore flows up into the pond 75 from underneath by means of an "underflow".

Figure 4:
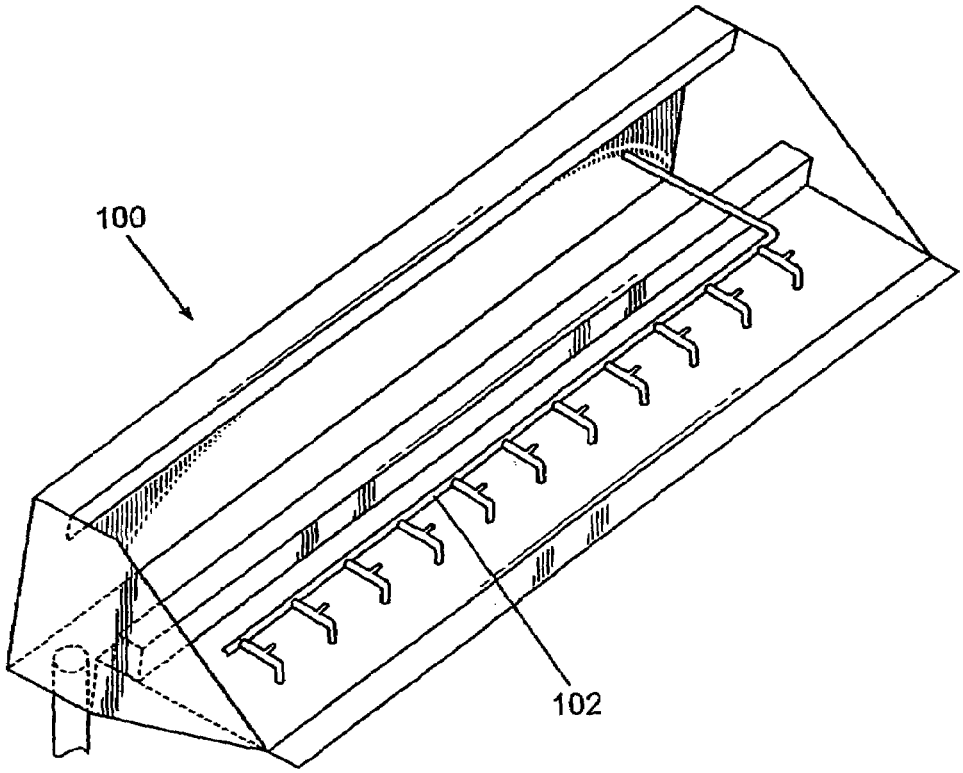
FIG. 4. is a perspective view of a prior art waterbox.

Preferably, the inlet openings 82 are supplied by a plurality of inlet supply conduits which in turn are supplied by mixture flowing in at least one header conduit. Each inlet supply conduit may be bent or elbowed as needed, given the spacing and configuration of the waterbox 60 and its associated calender stack. Each inlet supply conduit also preferably has at least one valve for regulating the flow of mixture in the pipe independently of the flow in the other inlet supply conduits. It is especially preferred that all of the aforementioned headers, supply pipes, and valves be provided outside of the waterbox so that there is no structure above the pond 75 onto which starch mixture may splatter, dry to a crust, and eventually fall into the mixture in the pond and find its way into the calendar stack or on the paper web. As discussed below, this has been found to significantly reduce the amount of dried starch buildup that may be released into the pond area of the waterbox 60. This is in decided contrast to conventional waterbox configurations. A typical prior art waterbox configuration 100 is illustrated in FIG. 4. As may be seen, starch mixtures typically have been provided to the waterbox 100 via a plurality of nozzles 102 located above the pond area. The nozzles, their associated supply pipes, valves and headers have all conventionally been located within the enclosure of the waterbox. However, as noted above, in this configuration the nozzles 102 and the associated piping typically become coated with starch solution in a short amount of time due to splashing and splattering of the mixture inherent in the operation of the waterbox and the calender stack. Given the elevated temperatures in the calender stack area, the starch solution rapidly dries on the nozzles 102 to form a crust. Eventually portions of the crust break away and are carried into the calender nip leading to paperweb defects.

By delivering the mixture to the waterbox from inside the pond area 75, the present invention eliminates overhead plumbing in the splash zone and thus greatly reduces the sites on which starch may collect and dry to form a crust above and around the pond. The resultant number of web defects due to scabbing is likewise reduced. In one instance a reduction in paper scabs of about 20% was observed for one calender stack and waterbox as compared to operation of the calender and waterbox with conventional overhead nozzles for starch mixture supply. The number of holes observed in the web due to dried starch pieces passing through the nip was reduced by over 40%. Moreover, by eliminating areas in which a hardened starch crust may form, cleanup of the waterbox is made easier and safer for the workers involved.

Figure 5:
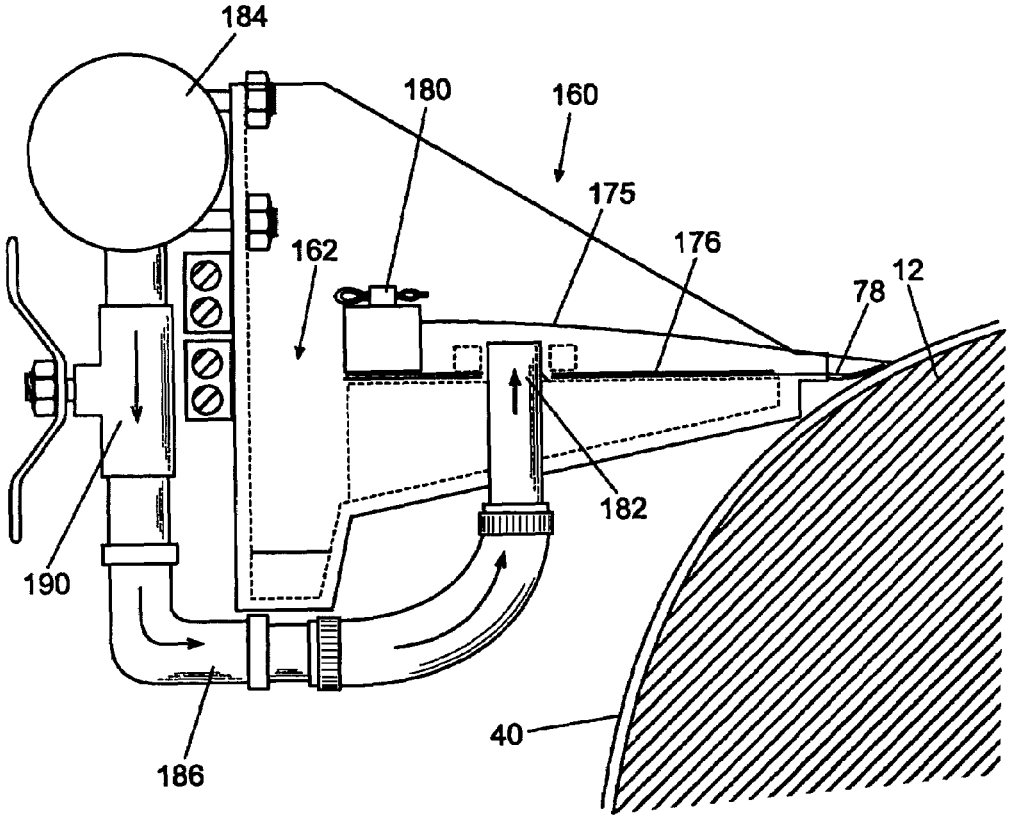
FIG. 5 is an elevational view of a second embodiment of the present invention.

FIG. 5 illustrates a particularly preferred embodiment of the inventive waterbox 160. As before, the waterbox 160 includes a spillway area 162, a pond 175 and pond area 176, a weir 180, and a plurality of inlets 182 in the plate beneath the pond area. In this embodiment, a waterbox which previously employed a conventional set of overhead nozzles is retrofitted according to the invention by means of use of a supply header 184 located behind the rear wall. The overhead nozzles, which previously extended forward over the pond area from a header located over the spillway are removed, and in their place, a series of "U-shaped" inlet supply conduits 186 are provided which supply the new inlet nozzles from underneath the waterbox as described above. Each of the inlet supply conduits 186 also preferably includes a valve 190 for regulating the flow of mixture through the conduit 186 and inlet 182 to balance the delivery of mixture across the width of the waterbox. One use of multiple values 190 in the multiple inlet supply conduits 186 spaced across the width of the box (preferably equally spaced) is to aid in maintaining what is known as a "dry edge." This is where the mixture in the pond does not extend completely across the full width of the web, but instead is caused to stop just short of the edge on each side.

In addition to reduction or elimination of the entrance of starch cut pieces, etc. into the pond area, it has been observed that, surprisingly, the degree of mixing or churning of the starch mixture within the waterbox is significantly improved according to the present invention. Consequently, the starch concentration is more uniform throughout the waterbox and the formation of "hot spots" is dramatically reduced along with the number of paperweb wrinkles and corrugations and holes in the web due to such hot spots.

Having now described various aspects of the invention and preferred embodiments thereof, it will be recognized by those of ordinary skill that numerous modifications, variations and substitutions may exist within the spirit and scope of the appended claims.

What is claimed is:

1. A waterbox for applying an aqueous mixture containing starch to a web in a calendar stack comprising:

an open-top elongate spillway disposed adjacent a calendar stack, said spillway having a bottom wall, front and rear walls, and first and second end walls;

an elongate lip extending from adjacent the front wall of the spillway to a position operably adjacent a roll of the calendar stack on which the web is disposed in order to provide a pond of the mixture which may flow from the lip onto the web;

a weir for controlling the level of the mixture in the pond such that the flow of the mixture from the pond onto the web is maintained, and disposed intermediate said lip and said rear wall and having a height selected to provide a basin within which the mixture may collect; and an inlet passing through said elongate lip for introduction of the mixture into the lip area, said inlet being located below the lip liquid level.

2. The waterbox of claim 1 further comprising a plurality of inlets for introduction of mixture into the lip area which are located below the pond level.

3. The waterbox of claim 2 wherein the plurality of inlets are located in the lip.

4. The waterbox of claim 2 wherein the elongate lip includes a rubber edge adjacent the calendar stack roll.

5. The waterbox of claim 2 wherein the liquid mixture comprises an aqueous starch mixture.

6. The waterbox of claim 2 wherein the weir may be adjusted to vary the pond level.

7. The waterbox of claim 2 further comprising at least one liquid mixture outlet located in the bottom plate for removing excess mixture from the waterbox.

8. The waterbox of claim 1 comprising:

an open-top elongate spillway disposed adjacent a roll of a calendar stack, said spillway having a bottom plate, substantially parallel front and rear walls, and substantially parallel first and second end walls;

an elongate pond area for supplying the mixture to the calendar stack which extends from adjacent the front wall of the spillway to a position adjacent a roll of the calendar stack;

a weir for controlling the amount of mixture in the pond area and establishing a pond mixture level; and an inlet passing through said elongate lip for introduction of mixture into the pond area; said inlet being located below the pond mixture.

9. The waterbox of claim 8 further comprising a plurality of inlets for introduction of mixture into the pond area which are located below the pond mixture level.

10. The waterbox of claim 9 wherein the plurality of inlets are located in an elongate lip.

11. The waterbox of claim 10 wherein the elongate lip includes a liquid seal adjacent the calendar stack roll.

12. The waterbox of claim 11 wherein the liquid seal comprises as elongate rubber lip.

13. The waterbox of claim 11 wherein the liquid seal extends from adjacent the calendar stack roll across the pond area to the weir.

14. The waterbox of claim 9 wherein the mixture comprises an aqueous starch mixture.

15. The waterbox of claim 9 wherein the weir may be adjusted to vary the pond mixture level.

16. The waterbox of claim 9 further comprising at least one mixture outlet located in the bottom plate for removing excess mixture from the waterbox.

17. The waterbox of claim 9 further comprising at least one header and a plurality of inlet supply pipes for supplying the liquid mixture to the plurality of inlets, wherein the header and the inlet supply pipes are all located outside of and adjacent to the waterbox.

18. The waterbox of claim 17 wherein each inlet supply pipe includes at least one valve for regulating flow of mixture and each valve is located outside of and adjacent to the waterbox.

19. The waterbox of claim 18 wherein the interior of the waterbox does not include any piping or valve fixtures.

20. The waterbox of claim 9 wherein the top of the weir is substantially flat and smooth.

* * * * *